US008236469B2

(12) United States Patent
Belknap et al.

(10) Patent No.: US 8,236,469 B2
(45) Date of Patent: Aug. 7, 2012

(54) SINGLE LAYER PHOTORECEPTOR COMPRISING HIGH MOBILITY TRANSPORT MIXTURES

(75) Inventors: Nancy L. Belknap, Rochester, NY (US); Katlyn Mallory, Rochester, NY (US); Helen Cherniack, Rochester, NY (US); Edward F. Grabowski, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/703,675

(22) Filed: Feb. 10, 2010

(65) Prior Publication Data

US 2011/0195353 A1 Aug. 11, 2011

(51) Int. Cl.
*G03G 5/06* (2006.01)

(52) U.S. Cl. ..... 430/73; 430/56; 430/78; 399/159

(58) Field of Classification Search ..... 430/56, 430/73, 78; 399/159
See application file for complete search history.

(56) References Cited

U.S. PATENT DOCUMENTS

| | | | | |
|---|---|---|---|---|
| 4,877,702 | A * | 10/1989 | Miyamoto et al. | 430/72 |
| 6,586,148 | B1 * | 7/2003 | Graham et al. | 430/58.65 |
| 6,946,227 | B2 * | 9/2005 | Lin et al. | 430/72 |
| 7,037,630 | B2 * | 5/2006 | Vong et al. | 430/56 |
| 7,070,892 | B2 | 7/2006 | Bender et al. | |
| 7,223,507 | B2 | 5/2007 | Ioannidis et al. | |
| 2002/0119385 | A1 * | 8/2002 | Azuma et al. | 430/96 |
| 2003/0059696 | A1 * | 3/2003 | Nabeta et al. | 430/96 |
| 2003/0211413 | A1 * | 11/2003 | Lin et al. | 430/78 |
| 2004/0018440 | A1 * | 1/2004 | Lin et al. | 430/83 |
| 2004/0086796 | A1 * | 5/2004 | Yu et al. | 430/58.15 |
| 2004/0197685 | A1 | 10/2004 | Ioannidis et al. | |
| 2005/0164106 | A1 | 7/2005 | Bender et al. | |
| 2007/0254226 | A1 * | 11/2007 | Yanus et al. | 430/58.75 |
| 2008/0138724 | A1 | 6/2008 | Belknap et al. | |
| 2008/0268359 | A1 * | 10/2008 | Lin et al. | 430/69 |

FOREIGN PATENT DOCUMENTS

| | | | |
|---|---|---|---|
| JP | 2000019758 A | * | 1/2000 |
| JP | 2002055472 A | * | 2/2002 |

OTHER PUBLICATIONS

Borsenberger, Paul M. and David Weiss. Organic Photoreceptors for Imaging Systems. New Yrok: Marcel-Dekker, Inc. (1993) pp. 6-17.*

U.S. Appl. No. 12/199,666, filed Aug. 27, 2008 entitled "Charge Transport Layer Having High Mobility Transport Molecule Mixture," Belknap et al.

* cited by examiner

*Primary Examiner* — Christopher Rodee
(74) *Attorney, Agent, or Firm* — Pillsbury Winthrop Shaw Pittman LLP

(57) ABSTRACT

The presently disclosed embodiments relate generally to layers that are useful in imaging apparatus members and components, for use in electrophotographic, including digital, apparatuses. In particular, the present embodiments pertain to an improved imaging member comprising a single layer in which the single layer further comprises a combination of one or more high mobility hole (charge) transport molecules and electron transport molecules.

11 Claims, 1 Drawing Sheet

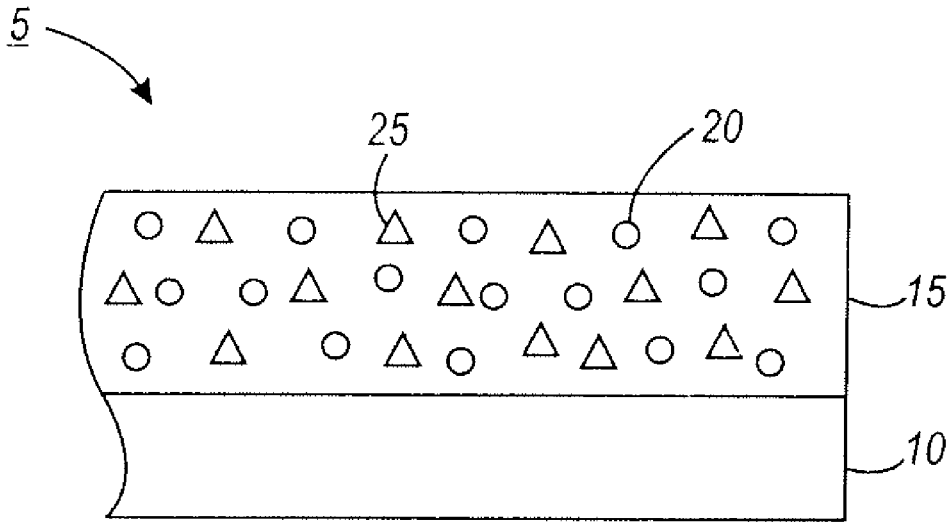
5
25
20
15
10

SINGLE LAYER PHOTORECEPTOR COMPRISING HIGH MOBILITY TRANSPORT MIXTURES

BACKGROUND

The presently disclosed embodiments relate generally to layers that are useful in imaging apparatus members and components, for use in electrophotographic, including digital, apparatuses. More particularly, the embodiments pertain to an improved electrophotographic imaging member comprising a single layer in which the single layer further comprises a combination of one or more hole (charge) and electron transport molecules. In embodiments, the single layer comprises a terphenyl or arylamine-based transport molecule combined with electron transport materials to provide high mobility of charge through the bulk of the single layer imaging member.

Electrophotographic imaging members, e.g., photoreceptors, photoconductors, and the like, typically include a photoconductive layer formed on an electrically conductive substrate. The photoconductive layer is an insulator in the substantial absence of light so that electric charges are retained on its surface. Upon exposure to light, charge is generated by the photoactive pigment, and under applied field charge moves through the photoreceptor and the charge is dissipated.

In electrophotography, also known as xerography, electrophotographic imaging or electrophotographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. Charge generated by the photoactive pigment moves under the force of the applied field. The movement of the charge through the photoreceptor selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

Typical multi-layered photoreceptors or imaging members have at least two layers, and may include a substrate, a conductive layer, an optional undercoat layer (sometimes referred to as a "charge blocking layer" or "hole blocking layer"), an optional adhesive layer, a photogenerating layer (sometimes referred to as a "charge generation layer," "charge generating layer," or "charge generator layer"), a charge transport layer, and an optional overcoating layer in either a flexible belt form or a rigid drum configuration. In the multi-layer configuration, the active layers of the photoreceptor are the charge generation layer (CGL) and the charge transport layer (CTL). Enhancement of charge transport across these layers provides better photoreceptor performance. Multi-layered flexible photoreceptor members may include an anti-curl layer on the backside of the substrate, opposite to the side of the electrically active layers, to render the desired photoreceptor flatness.

A drawback to the multi-layered photoreceptors is that such photoreceptors are costly and complicated to manufacture and maintain. Ideally, single layer photoreceptors would be used due to their simple design and cost efficiency. Such photoreceptors are disclosed in U.S. Pat. Nos. 7,070,892 and 7,223,507, and U.S. Publication Nos. 20040197685 and 20050164106, which are hereby incorporated by reference in their entireties. Single layer organic photoreceptors represent the most efficient photoreceptor structure for resolution, cost of manufacture and maintenance and manufacturing simplicity. The main advantages over multi-layer photoreceptors stem from the generating property of the top-surface of the single layer design. Photogeneration at the top surface eliminates the need for anti-plywood treatment of the substrate and also eliminates charge spreading, thus facilitating higher resolution imaging. In addition, single layer photoreceptors allow for greater layer thickness to be used for the single layer and provides for more wear resistance and thus longer photoreceptor life.

However, there are obstacles to obtaining a single layer photoreceptor that operates as desired. The difficulty in designing a usable single layer photoreceptor lies in the selection of compatible hole and electron transport materials, which must also be compatible with the selected pigment and binder. Many problems need to be overcome including charge acceptance for hole and/or electron transporting materials from photoelectroactive pigments. In addition to electrical compatibility and performance, a material mix for forming a single layer photoreceptor should possess the proper rheology and resistance to agglomeration to enable acceptable coatings.

Because it is very difficult to find a combination that meets all of the above requirements, multi-layered devices have generally been used.

Thus, there is a need for an improved photoreceptor design, such as a single layer device, that avoids the problems such as that described above.

The term "photoreceptor" or "photoconductor" is generally used interchangeably with the terms "imaging member." The term "electrostatographic" includes "electrophotographic" and "xerographic." The terms "charge transport molecule" are generally used interchangeably with the terms "hole transport molecule."

SUMMARY

According to aspects illustrated herein, there is an imaging member comprising an imaging member comprising a substrate, and a single layer disposed over the substrate, the single layer further comprising a pigment, a binder, and a combination of high mobility charge transport molecules and electron transport molecules, wherein the high mobility charge transport molecules are selected from the group consisting of arylamine-based transport molecules, terphenyl-based transport molecules, and mixtures thereof.

Another embodiment provides an imaging member comprising an imaging member comprising a substrate, and a single layer disposed over the substrate, wherein the single layer is formed from a solution comprising a pigment, a binder, and a combination of high mobility charge transport molecules and electron transport molecules dissolved in a solvent, the high mobility charge transport molecules being selected from the group consisting of arylamine-based transport molecules, terphenyl-based transport molecules, and mixtures thereof.

Yet another embodiment, there is an imaging member comprising an image forming apparatus for forming images on a recording medium comprising: (a) an imaging member having a charge retentive-surface for receiving an electrostatic latent image thereon, wherein the imaging member comprises a substrate, and a single layer disposed over the substrate, the single layer further comprising a pigment, a binder, and a combination of high mobility charge transport molecules and electron transport molecules, wherein the high mobility charge transport molecules are selected from the group consisting of terphenyl-based transport molecules, arylamine-based transport molecules, and mixtures thereof, (b) a development component for applying a developer material to the charge-retentive surface to develop the electrostatic latent image to form a developed image on the charge-retentive surface, (c) a transfer component for transferring the developed image from the charge-retentive surface to a copy substrate, and (d) a fusing component for fusing the developed image to the copy substrate.

BRIEF DESCRIPTION OF THE DRAWINGS

For a better understanding, reference may be made to the accompanying FIGURE.

The FIGURE is a cross-sectional view of an imaging member having a single layer configuration according to the present embodiments.

DETAILED DESCRIPTION

In the following description, reference is made to the accompanying drawing, which form a part hereof and which illustrate several embodiments. It is understood that other embodiments may be used and structural and operational changes may be made without departure from the scope of the present disclosure.

The presently disclosed embodiments are directed generally to an electrophotographic imaging member which comprises a single layer in which the single layer further comprises a combination of one or more hole (charge) and electron transport molecules. In embodiments, the single layer comprises a terphenyl or arylamine-based transport molecule combined with electron transport materials to provide high mobility of charge through the bulk of the single layer imaging member. Hole transport materials typically have zero field charge transport mobilities in the range of $10^{-6}$ to $10^{-4}$ $cm^2V^{-1}s^{-1}$, which is about two orders of magnitude greater than electron transport materials with typical mobiities in the $10^{-8}$ to $10^{-7}$ $cm^2V^{-1}s^{-1}$ range as determined in molecularly doped polymeric transport layers. A positive charging single layer photoreceptor device, accommodates for the difference in mobility by requiring negative charge transport at the top surface where the charge has less distance to travel. Hole transport mobilities of the present embodiments are two to four times greater than the comparative example. Such "high mobility" hole transport compounds exhibit good compatibility with the binder, produce reduced or no crystallization of the hole transport molecules, and enable addition of the material in the device at lower levels thereby enabling the addition of increased electron transport molecule. The single layer imaging member provides a highly efficient structure for image resolution, manufacturing simplicity and imaging member longevity.

In a typical electrophotographic reproducing or digital printing apparatus using a photoreceptor, a light image is recorded in the form of an electrostatic latent image upon a photosensitive member and the latent image is subsequently rendered visible by the application of a developer mixture. The developer, having toner particles contained therein, is brought into contact with the electrostatic latent image to develop the image on an electrophotographic imaging member which has a charge-retentive surface. The developed toner image can then be transferred to a copy substrate, such as paper, that receives the image via a transfer member.

Typical photoreceptors or imaging members are based upon a multi-layered configuration. As discussed in the background section, however, multi-layered photoreceptors are costly and complicated to manufacture and maintain, and ideally, a single layer photoreceptor is more desirable for use due to their simple design and cost efficiency. As also discussed in the background section, it is difficult to obtain a single layer photoreceptor that operates as desired because such a configuration requires the selection of compatible hole and electron transport materials, which must also be compatible with the selected pigment. Additionally, each of the selected materials must also be soluble in the same solvent/binder system and allow good capacitive charging while also providing good transport of photogenerated charge.

In the present embodiments, a single layer imaging member is achieved which avoids the above-described problems. The single layer comprises a combination of one or more high mobility hole transport molecules with one or more electron transport materials to facilitate the movement of charge through the bulk of a positive charging single layer device with improved performance providing operation at increased process speeds while maintaining a lower residual voltage. The present embodiments provide compatible combinations of high mobility transport molecules and electron transport molecules which are also compatible with selected pigments in embodiments and soluble in the provided embodiments of the solvent/binder system.

Furthermore, these transport molecules require lower loading levels of hole transport molecule, thus facilitating the incorporation of higher concentrations of electron transport molecules which helps to compensate for the low mobility of the electron transport molecules. The novel combinations of hole and electron transport molecules in polymer binder ("transport matrices") for single layer photoreceptors demonstrated improved electrical performance as seen in sharper photoinduced discharge curves (PIDC) and lower residual voltage ($V_r$).

The exemplary embodiments of this disclosure are described below with reference to the FIGURE. The specific terms are used in the following description for clarity, selected for illustration in the FIGURE and not to define or limit the scope of the disclosure. The structures in the FIGURE are not drawn according to their relative proportions and the drawing should not be interpreted as limiting the disclosure in size, relative size, or location. In addition, though the discussion will address negatively charged systems, the imaging members of the present disclosure may also be used in positively charged systems.

The FIGURE is an exemplary embodiment of a single-layered electrophotographic imaging member 5. As can be seen, the exemplary imaging member includes a rigid support substrate 10, and a single layer 15 disposed over the substrate 10. The rigid substrate may be comprised of a material selected from the group consisting of a metal, metal alloy, aluminum, zirconium, niobium, tantalum, vanadium, hafnium, titanium, nickel, stainless steel, chromium, tungsten, molybdenum, and mixtures thereof. The single layer 15 comprises a novel combination of high mobility hole transport molecules 20 and electron transport molecules 25 in polymer binder ("transport matrices").

The Substrate

The photoreceptor support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed, such as for example, metal or metal alloy. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, niobium, stainless steel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and/or oxides.

The substrate 10 can also be formulated entirely of an electrically conductive material, or it can be an insulating material including inorganic or organic polymeric materials, such as MYLAR, a commercially available biaxially oriented polyethylene terephthalate from DuPont, or polyethylene naphthalate available as KALEDEX 2000, with a ground plane layer 12 comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate 10 may have a number of many different configurations, such as for example, a plate, a cylinder, a drum, a scroll, an endless flexible belt, and the like. In the case of the substrate being in the form of a belt, the belt can be seamed or seamless. In embodiments, the photoreceptor herein is in a drum configuration.

The thickness of the substrate 10 depends on numerous factors, including flexibility, mechanical performance, and economic considerations. The thickness of the support substrate 10 of the present embodiments may range from about 500 micrometers to about 3,000 micrometers, or from about 750 micrometers to about 2500 micrometers.

An exemplary substrate support 10 is not soluble in any of the solvents used in each coating layer solution, is optically transparent or semi-transparent, and is thermally stable up to a high temperature of about 150° C. A typical substrate support 10 used for imaging member fabrication has a thermal contraction coefficient ranging from about $1\times10^{-5}$ per° C. to about $3\times10^{-5}$ per ° C. and a Young's Modulus of between about $5\times10^{-5}$ psi ($3.5\times10^{-4}$ Kg/cm$^2$) and about $7\times10^{-5}$ psi ($4.9\times10^{-4}$ Kg/cm$^2$).

The Single Layer

The single layer 15 is disposed upon the substrate 10. The single layer 15 comprises a combination of one or more high mobility hole and electron transport molecules. In embodiments, the high mobility hole transport molecules may include arylamine-based transport molecule, including both terphenyl-based and non-terphenyl-based transport molecules, and mixtures thereof. In the present embodiments, the non-terphenyl-based arylamine transport molecules are selected from the group consisting of N,N'-diphenyl-N,N'-bis(alkylphenyl)-1,1-biphenyl-4,4'-diamine (mTBD), N,N,N',N'-tetra(4-methylphenyl)-(1,1'-biphenyl)-4,4'-diamine or tetramethyl-TBD (TM-TBD), N,N'-diphenyl-N,N'-dip-tolyl-biphenyl-4,4'-diamine (p-TPD), N,N'-bis-(4-methoxy-phenyl)-N,N'-diphenyl-biphenyl-4,4"-diamine (p-MeOTPD), N,N,N',N'-tetra-p-tolyl-1,1'-biphenyl-4,4'-diamine (TM-TPD), tritolylamine (TTA),. N,N'-bis-(3,4-dimethylphenyl)-4-biphenyl amine (bp-Amine), N,N'-bis-(4-methylphenyl)-N,N'-bis(4-ethylphenyl)-1,1'-3,3'-dimethylbiphenyl)-4,4'-diamine, and mixtures thereof. In further embodiments, the terphenyl-based arylamine transport molecules are selected from the group consisting of N,N'-bis(4-methylphenyl)-N,N'-bis[4-(n-butyl)phenyl]-[p-terphenyl]-4,4"-diamine, N,N'-bis(3-methylphenyl)-N,N'-bis[4-(n-butyl)phenyl]-[p-terphenyl]-4,4"-diamine, N,N'-bis(4-tert-butylphenyl)-N,N'-bis[4-(n-butyl)phenyl]-[p-terphenyl]-4,4"-diamine (4-tBuTer), N,N'-bis(3,4-dimethylphenyl)-N,N'-bis[4-(n-butyl)phenyl]-[p-terphenyl]-4,4"-diamine, and mixtures thereof.

In the present embodiments, the hole transport molecules are combined with compatible electron transport molecules to form the single layer. In embodiments, the electron transport molecules may include N,N' bis(1,2-dimethylpropyl)-1,4,5,8-naphthalenetetracarboxylic diimide (NTDI) and substituted NTDI (for higher solubility)(in a particular embodiment, the substituent is bis(2-heptylimido)perinone), butoxy carbonyl fluorenylidene malononitrile (BCFM), ethyl hexyl carbonyl fluorenylidene malononitrile (2-EHCFM) (having higher solubility than BCFM), and "BIB-CNs," which include but are not limited to di(n-butyl)benzophenone bisimide, bis(isobutyl)benzophenone bisimide and bis(sec-butyl)benzophenone bisimide, 2-(4-methylphenyl)-6-phenyl-4H-thiopyran-4-ylidene]-propanedinitril-1,1-dioxide (CAS#135215-38-2, ST-749 commercially available from Sensient Technologies Corp. (Milwaukee, Wis.)) and mixtures thereof. Perylenes may also be used to enhance electron transport as they are extrinsic charge generator pigments with known electron transport ability in pure, undiluted form. In specific embodiments, the high mobility transport molecule is present in the single layer in an amount of from about 25 percent to about 45 percent by weight of the total weight of the dried single layer. In specific embodiments, the electron transport molecule is present in the single layer in an amount of from about 10 percent to about 25 percent by weight of the total weight of the dried single layer. In further embodiments, a ratio of the high mobility transport molecules to electron transport molecules in the single layer is from about 45:5 to about 25:25, or from about 40:10 to about 30:20.

The single layer may further comprise pigments and binders compatible with the hole and electron transport molecules. In embodiments, the pigments may include metal-free phthalocyanines, trivalent metal-phthalocyanines such as chlorogallium phthalocyanine (ClGaPc), metal-phthalocyanines such as hydroxygallium phthallocyanine (OHGaPc) and titanyl phthalocyanine (OTiPc), benzylimidizo perylene (BZP), 535+dimer (Vision pigment), and mixtures thereof. In specific embodiments, the pigment is present in the single layer in an amount of from about 1 percent to about 3 percent by weight of the total weight of the single layer. In embodiments, the binders may include 4,4'-cyclohexylidenebisphenol (Bisphenol Z)-type polycarbonate, Bisphenol-Z polycarbonate (PCZ); PCZ-500, a polycarbonate having a weight average molecular weight of 51,000, PCZ-400, a polycarbonate having a weight average molecular weight of 40,000, PCZ-800, a polycarbonate having a weight average molecular weight of 80,000, and mixtures thereof. In specific embodiments, the binder is present in the single layer in an amount of from about 40 percent to about 60 percent by weight of the total weight of the single layer.

In the present embodiments, the single layer is formed from a solution comprising a pigment, a binder, and a combination of high mobility charge transport molecules and electron transport molecules dissolved in a solvent. In embodiments, the coating solvent may be tetrahydrofuran (THF), monochlorobenzene (MCB), cyclohexanone, methylene chloride, toluene, and mixtures thereof. In embodiments, the solvent is present in an amount of from about 60 percent to about 80 percent by weight of the total weight of the single layer coating solution. In embodiments, the pigment may be present in an amount of from about 8 percent to about 23 percent by weight of the total weight of the single layer coating solution, the binder may be present in an amount of from about 8 percent to about 12 percent by weight of the total weight of the single layer coating solution, and the combination of the high mobility transport and electron transport molecules may be present in an amount of from about 8 percent to about 12 percent by weight of the total weight of the single layer coating solution.

Examples of components or materials optionally incorporated into the single layer of the imaging member, for example, enable improved lateral charge migration (LCM) resistance include hindered phenolic antioxidants such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZERT™ BHT-R, MDP-S, BBM-S, WX-R, NW, BP-76, BP-101, GA-80, GM and GS (available from Sumitomo Chemical Co., Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SANKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER® TPS (available from Sumitomo Chemical Co., Ltd.); thioether antioxidants such as SUMILIZER® TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N2-hydroxyethyl-N-ethyl-aminophenyl)]-phenylmethane (DHTPM), and the like. The weight percent of the antioxidant in the single layer is from about 0 to about 20, from about 1 to about 10, or from about 3 to about 8 weight percent.

Any suitable and conventional technique may be utilized to form and thereafter apply the single layer 15 to the supporting substrate layer 10. The single layer may be formed in a single coating step or in multiple coating steps. Dip coating, ring coating, spray, gravure or any other drum coating methods may be used.

Drying of the deposited coating may be effected by any suitable conventional technique such as oven drying, infra red radiation drying, air drying and the like. The thickness of the single layer after drying is, in embodiments, from about 10 μm to about 35 μm, or from about 12 μm to about 28 μm, or from about 14 μm to about 21 μm. As provided, the single layer may have a thickness that is thicker than conventional photoreceptor layers. Because the present embodiments provide such a thick single layer, the imaging member is much more wear-resistance and facilitates longer service life.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Example 1

Terphenyl-based Single Layer Photoreceptor

A pigment dispersion was prepared by roll milling 6.3 grams of Type V hydroxygalliumphthalocyanine pigment particles and 6.3 grams of poly(4,4'-diphenyl-1,1'-cyclohexane carbonate) binder (PcZ200, available from Teijin Chemical, Ltd.) in 107.4 grams of tetrahydrofuran (THF) with several hundred, e.g., about 700 to 800 grams, of 3 millimeter diameter steel or yttrium zirconium balls for about 24 to 72 hours.

Separately, 1.86 grams of binder (PcZ500 (average molecular wt. 51,000), available from Teijin Chemical, Ltd.), was weighed with 1.2 grams of N,N'-bis(4-methylphenyl)-N,N'-bis[4-(n-butyl)phenyl]-[p-terphenyl]-4,4"-diamine(p-MeTer), 0.80 grams of ethylhexylcarbonyl fluorenylidene malononitrile (EHCFM), 12.8 grams of THF, and 2.03 grams of toluene. This mixture was rolled in a glass bottle until the solids were dissolved; then an aliquot of the above pigment dispersion were added to form a final dispersion containing the Type V hydroxy gallium phthalocyanine, PcZ Binder, pMeTer, EHCFM in a solids weight ratio of (1.8:48.2:30:20) and a total solid contents of 20 weight percent; and rolled to further mix (without milling beads). The dispersion was applied by ring coating to aluminum drums having a length of 24 to 36 centimeters and a diameter of 30 millimeters. The device was dried for 40 min. at 120° C. and the resulting photosensitive layer was about 16 um in thickness. Additional samples were similarly prepared using weight ratio of hole transport molecule to electron transport molecule 40:10.

Example 2

Example 2 was similarly prepared as Example 1 except that the hole transporting molecule was replaced with N,N,N',N'-tetra-p-tolyl-1,1'-biphenyl-4,4'-diamine (TM-TPD) to form a final single layer device containing the Type V hydroxy gallium phthalocyanine, PcZ binder, triphenyl amine, TM-TPD, EHCFM in a solids weight ratio of (1.8:48.2:30:20) Additional samples were similarly prepared using weight ratio of hole transport molecule to electron transport molecule 40:10.

Example 3

Example 3 was similarly prepared as Example 1 except that the hole transporting molecule was replaced with (N,N'-diphenyl-N,N'-dip-tolyl-biphenyl-4,4'-diamine(p-TPD) to form a final single layer device containing the Type V hydroxy gallium phthalocyanine, PcZ Binder, triphenyl amine, p-TPD, EHCFM in a solids weight ratio of (1.8:48.2:30:20) Additional samples were similarly prepared using weight ratio of hole transport molecule to electron transport molecule 40:10.

Example 4

Same as Example 1 except electron transport material replaced by 2-(4-methylphenyl)-6-phenyl-4H-thiopyran-4-ylidene]-propanedinitril-1,1-dioxide (CAS#135215-38-2, ST-749 commercially available from Sensient Technologies Corp. (Milwaukee, Wis.)).

Example 5

Same as Example 3 except electron transport material replaced by 2-(4-methylphenyl)-6-phenyl-4H-thiopyran-4-ylidene]-propanedinitril-1,1-dioxide (CAS#135215-38-2, ST-749 commercially available from Sensient Technologies Corp. (Milwaukee, Wis.)).

Comparative Example

The Comparative Example was similarly prepared as Example 1 except that the hole transporting molecule was replaced with biphenyl-4-yl-bis-(3,4-dimethyl-phenyl)-amine (bp-Amine) to form a final single layer device containing the Type V hydroxy gallium phthalocyanine, PcZ Binder, bp-Amine, EHCFM in a solids weight ratio of (1.8:48.2:30:20). Additional samples were similarly prepared using weight ratio of hole transport molecule to electron transport molecule 40:10.

Electrical Property Testing

The photoreceptor devices were tested in a scanner set to obtain photoinduced discharge cycles, sequenced at two charge-erase cycles followed by one charge-expose-erase cycle, wherein the light intensity was incrementally increased with cycling to produce a series of photo induced discharge characteristic curves from which the surface potentials at various exposure intensities are measured. Additional electrical characteristics were obtained by a series of charge-erase cycles with incrementing surface potential to generate several voltage versus charge density curves. The scanner was equipped with a corotron set to supply constant current charging at various surface potentials. The devices were positively charge to an initial surface potential of 400 volts with the exposure light intensity incrementally increased by means of regulating a series of neutral density filters; the exposure wavelength was controlled by a band filter at 780±5 nanometers. The exposure light source was a 1,000 watt Xenon white light source.

The xerographic simulation was completed in an environmentally controlled light tight chamber at ambient conditions (30 percent relative humidity and 22° C.). A photoinduced discharge characteristic (PIDC) curve was generated for each of the above prepared photoconductors at 188 mm/s process speed. The results are summarized in Table 1, where the discharge potential, V is measured at a light exposure energy of 2 ergs, the photosensitivity is calculated from the initial slope of the discharge curve at low intensity exposures and Vr is the residual voltage.

TABLE 1

| Sample | Examples | (HTM:ETM) Ratio | V (2erg) | Photosensitivity (V*cm2/erg) | Vr | DD (V/s) |
|---|---|---|---|---|---|---|
| Comparative | bp- | (30:20) | 175 | 216 | 41 | 76.7 |
| Example 1 | Amine:2EHCFM | (40:10) | 198.7 | 235 | 73 | 56.0 |
| Example 1 | pMeTer:EHCFM | (30:20) | 146.2 | 213 | 34 | 71.3 |
| | | (40:10) | 174.2 | 253 | 64 | 87.3 |
| Example 2 | p-TBD:2EHCFM | (30:20) | 155 | 217 | 36 | 98.6 |
| | | (40:10) | 176.5 | 238 | 65 | 87.4 |
| Example 3 | TM-TBD:2EHCFM | (30:20) | 176.2 | 171 | 40 | 92.7 |
| Example 4 | pMeTer:ST-749 | (30:20) | 188.4 | 124 | 30 | 77.1 |
| | | (40:10) | 196 | 150 | 68 | 85.8 |
| Example 5 | p-TBD:ST-749 | (30:20) | 204 | 157 | 17 | 90.7 |
| | | (40:10) | 211 | 129 | 48 | 67.3 |

From the table above, it is clear that the materials and ratios are both critical factors in the device formulation. The EHCFM electron transport material is an excellent match to the hydroxygallium pigment shown by the dramatic increase in device photosensitivity. The high mobility hole transport molecules are more effective in moving charge out of the device as demonstrated by the decrease in the $V_{2erg}$, while maintaining a low residual voltage and photosensitivity relative to the comparative example of earlier work. The high mobility transport molecules enable the use of increased concentrations of electron transport material, with the optimal material ratios closer to the 30:20 wt. ratio of hole to electron transport molecule. The pMeTer:EHCFM at the 30:20 weight ratio is superior in discharge characteristics with a lower residual voltage, dark decay rate, and discharge potential while maintaining the device photosensitivity.

The photoreceptor devices were tested in a cycling fixture set to induce 50,000 charge erase cycles at various process speeds to electrically exercise the device. The fixture was equipped with a single wire charge scorotron set to supply a constant voltage, and with a 660 nm LED erase light. The devices were positively charge to an initial surface potential of 400 volts with the erase light intensity fixed to achieve a minimum discharge potential. The cyclic testing was completed in an environmentally controlled light tight chamber at ambient conditions (30 percent relative humidity and 22° C.) at a process speed of 785 mm/s. The change in the charge potential, ΔVo and the change in residual potential ΔVr were monitored over the course of the cyclic test and are summarized in Table 2.

TABLE 2

| Sample | Examples | (HTM:ETM) Ratio | ΔVo (V) | ΔVr (V) | Vr @50 Kc |
|---|---|---|---|---|---|
| Comparative | bp- | (30:20) | 5 | 17 | 125 |
| Example 1 | Amine:2EHCFM | (40:10) | −7 | 33 | 143 |
| Example 1 | pMeTer:EHCFM | (30:20) | −2 | −17 | 77 |
| Example 2 | p-TBD:2EHCFM | (30:20) | −6 | 11 | 109 |
| Example 3 | TM-TBD:2EHCFM | (30:20) | −18 | 18 | 111 |

The devices exhibit stable electrical cycling behavior with little cyclic change in Vo or Vr during cycling. The residual potential for the high mobility molecules remains lower than the comparative example, demonstrating the superior transport through the bulk of the device.

All the patents and applications referred to herein are hereby specifically, and totally incorporated herein by reference in their entirety in the instant specification.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An imaging member comprising:

a substrate; and a single layer disposed over the substrate, the single layer further comprising a Type V hydroxygallium phthalocyanine pigment, a binder, and a combination of high mobility charge transport molecules and electron transport molecules, wherein the high mobility charge transport molecules are selected from the group consisting of N,N'-bis(4-methylphenyl)-N,N'-bis[4-(n-butyl)phenyl]-[p-terphenyl]-4,4"-diamine, N,N,N',N'-tetra-p-tolyl-1,1'-biphenyl-4,4'-diamine, and mixtures thereof, and the electron transport molecule is ethyl hexyl carbonyl fluorenylidene malononitrile;

wherein a weight ratio of the high mobility charge transport molecules to electron transport molecules is from 40:10 to 30:20, based on the total weight of the single layer.

2. The imaging member of claim 1, wherein the single layer has a thickness of from about 10 μm to about 35 μm.

3. The imaging member of claim 2, wherein the single layer has a thickness of from about 12 μm to about 28 μm.

4. The imaging member of claim 3, wherein the single layer has a thickness of from about 14 μm to about 21 μm.

5. The imaging member of claim 1, wherein a weight ratio of the high mobility charge transport molecules to electron transport molecules is 40:10.

6. The imaging member of claim 1, wherein the binder is a 4,4'-cyclohexylidenebisphenol (Bisphenol Z)-type polycarbonate selected from the group consisting of a Bisphenol-Z polycarbonate (PCZ) having a weight average molecular weight of 40,000, a Bisphenol-Z polycarbonate (PCZ) having a weight average molecular weight of 51,000, and Bisphenol-Z polycarbonate (PCZ) having a weight average molecular weight of 80,000.

7. An imaging member comprising:

a substrate; and a single layer disposed over the substrate, wherein the single layer is formed from a solution comprising a Type V hydroxygallium phthalocyanine pigment, a binder, and a combination of high mobility charge transport molecules and electron transport molecules dissolved in a solvent, the high mobility charge transport molecules being selected from the group consisting of N,N'-bis(4-methylphenyl)-N,N'-bis[4-(n-butyl)phenyl]-[p-terphenyl]-4,4"-diamine, N,N,N',N'-tetra-p-tolyl-1,1'-biphenyl-4,4'-diamine, and mixtures thereof, and the electron transport molecule is ethyl hexyl carbonyl fluorenylidene malononitrile;

wherein a weight ratio of the high mobility charge transport molecules to electron transport molecules is from 40:10 to 30:20, based on the total weight of the single layer.

8. The imaging member of claim 7, wherein the solvent is selected from the group consisting of tetrahydrofuran, monochlorobenzene, cyclohexanone, methylene chloride, toluene, and mixtures thereof.

9. An image forming apparatus for forming images on a recording medium comprising:

a) an imaging member having a charge retentive-surface for receiving an electrostatic latent image thereon, wherein the imaging member comprises a substrate, and a single layer disposed over the substrate, the single layer further comprising a Type V hydroxygallium phthalocyanine pigment, a binder, and a combination of high mobility charge transport molecules and electron transport molecules, wherein the high mobility charge transport molecules are selected from the group consisting of N,N'-bis(4-methylphenyl)-N,N'-bis[4-(n-butyl)phenyl]-[p-terphenyl]-4,4"-diamine, N,N,N',N'-tetra-p-tolyl-1,1-biphenyl-4,4'-diamine, and mixtures thereof, and the electron transport molecule is ethyl hexyl carbonyl fluorenylidene malononitrile; wherein a weight ratio of the high mobility charge transport molecules to electron transport molecules is from 40:10 to 30:20, based on the total weight of the single layer;

b) a development component for applying a developer material to the charge-retentive surface to develop the electrostatic latent image to form a developed image on the charge-retentive surface;

c) a transfer component for transferring the developed image from the charge-retentive surface to a copy substrate; and d) a fusing component for fusing the developed image to the copy substrate.

10. The image forming apparatus of claim 9, wherein the single layer has a thickness of from about 10 μm to about 35 μm.

11. The image forming apparatus of claim 9, wherein a weight ratio of the high mobility charge transport molecules to electron transport molecules is 40:10.

* * * * *